US008382609B2

(12) United States Patent
Yokota

(10) Patent No.: US 8,382,609 B2
(45) Date of Patent: Feb. 26, 2013

(54) GOLF CLUB HEAD AND METHOD FOR MANUFACTURING THE SAME

(75) Inventor: Masatoshi Yokota, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 595 days.

(21) Appl. No.: 12/411,830

(22) Filed: Mar. 26, 2009

(65) Prior Publication Data

US 2009/0286622 A1 Nov. 19, 2009

(30) Foreign Application Priority Data

May 13, 2008 (JP) ..... 2008-126253

(51) Int. Cl.
*A63B 53/00* (2006.01)

(52) U.S. Cl. ..... 473/346; 473/350; 473/342

(58) Field of Classification Search ..... 473/349–350, 473/345, 346, 342
See application file for complete search history.

(56) References Cited

U.S. PATENT DOCUMENTS 5,830,084 A * 11/1998 Kosmatka ..... 473/349
5,842,934 A * 12/1998 Ezaki et al. ..... 473/342
5,971,868 A * 10/1999 Kosmatka ..... 473/349
6,007,432 A * 12/1999 Kosmatka ..... 473/324
D418,887 S * 1/2000 Williams, Jr. ..... D21/749
6,193,614 B1 * 2/2001 Sasamoto et al. ..... 473/329
6,413,169 B1 * 7/2002 Kosmatka ..... 473/329
6,471,603 B1 * 10/2002 Kosmatka ..... 473/324
6,840,872 B2 * 1/2005 Yoneyama ..... 473/346
6,904,663 B2 * 6/2005 Willett et al. ..... 29/557
6,997,820 B2 * 2/2006 Willett et al. ..... 473/329
7,387,579 B2 * 6/2008 Lin et al. ..... 473/332
7,442,132 B2 * 10/2008 Nishio ..... 473/342
7,481,717 B2 * 1/2009 Knuth ..... 473/329
7,578,755 B2 * 8/2009 Oyama ..... 473/342
7,749,102 B2 * 7/2010 Nakamura ..... 473/342
2001/0051548 A1 * 12/2001 Iwata et al. ..... 473/329
2002/0065146 A1 * 5/2002 Kusumoto ..... 473/345
2003/0181257 A1 * 9/2003 Yamamoto ..... 473/342
2004/0082404 A1 * 4/2004 Willett et al. ..... 473/342
2004/0083596 A1 * 5/2004 Willett et al. ..... 29/557
2004/0219991 A1 * 11/2004 Suprock et al. ..... 473/329
2005/0003901 A1 * 1/2005 Kuroda et al. ..... 473/324
2005/0009624 A1 * 1/2005 Long ..... 473/329
2005/0090331 A1 * 4/2005 Oyama ..... 473/345
2005/0101407 A1 * 5/2005 Hirano ..... 473/342
2006/0063606 A1 * 3/2006 Schweigert et al. ..... 473/329
2006/0094531 A1 * 5/2006 Bissonnette et al. ..... 473/329
2006/0194644 A1 * 8/2006 Nishio ..... 473/329
2006/0287132 A1 * 12/2006 Meyer et al. ..... 473/345

(Continued)

*Primary Examiner* — Gene Kim
*Assistant Examiner* — Matthew B Stanczak
(74) *Attorney, Agent, or Firm* — Birch, Stewart, Kolasch & Birch, LLP

(57) ABSTRACT

A golf club head has a hollow structure comprising a main body member and a face member. The face member is made of an unidirectionally rolled plate of a titanium alloy having alpha phase crystals. The rolled direction of the unidirectionally rolled plate is inclined at an angle θ1 of not more than 30 degrees with respect to the horizontal direction. The face member is provided on the rear face with a ribbed part having its longitudinal direction inclined at an angle θ2 of not more than 30 degrees with respect to the vertical direction. A method for manufacturing the golf club head comprises a step of preparing the face member which comprises the steps of: preparing the unidirectionally rolled plate; cutting out a blank for the face member from the unidirectionally rolled plate; and forming the ribbed part on the cutout blank by machining.

12 Claims, 10 Drawing Sheets

U.S. PATENT DOCUMENTS

2006/0293118 A1* 12/2006 Meyer et al. ..... 473/329
2007/0015601 A1* 1/2007 Tsunoda et al. ..... 473/346
2007/0066420 A1* 3/2007 Imamoto et al. ..... 473/329
2007/0270236 A1 11/2007 Hirano
2010/0105501 A1* 4/2010 Wada et al. ..... 473/346

* cited by examiner

E 1 section

GOLF CLUB HEAD AND METHOD FOR MANUFACTURING THE SAME

BACKGROUND OF THE INVENTION

The present invention relates to a golf club head, more particularly to a face structure capable of controlling the spring-like effect of the face portion without increasing the mass of the face portion, and a method for manufacturing the same.

Recent years, according to the Rules of Golf, golf club heads having a high spring-like effect can not be used. More specifically, the characteristic time of the club head shall not be greater than 239 microseconds with a test tolerance of 18 microseconds. In brief, the spring-like effect is such that when a ball hits the face portion of a hollow golf club head, the face portion is deformed and bounds the ball like a trampoline, and the initial ball speed of the ball is increased.

Accordingly, by increasing the rigidity of the face portion, the deformation at impact is lessened to lower the spring-like effect. The rigidity of the face portion can be increased by increasing the thickness thereof. But, if the thickness is increased, the mass of the face portion is increased accordingly, and the depth of the center of gravity of the head becomes decreased. As a result, motion of the club head at the time of off-center shots (miss shots) increases, and the directionality of the hit ball deteriorates.

SUMMARY OF THE INVENTION

A primarily object of the present invention is therefore, to provide a golf club head in which the spring-like effect is adjusted as high as possible while conforming to the Rules of Golf without substantial increase in the mass of the face portion.

A further object of the present invention is to provide a method for manufacturing the golf club head, in which in order to adjust the spring-like effect, the rigidity of the face portion can be controlled by utilizing a specific combination of a thickness distribution and an anisotropy of a unidirectionally rolled titanium alloy plate.

According to one aspect the present invention, a golf club head has a hollow structure comprising a main body member provided with an opening in the front thereof, and a face member closing the opening so as to form a hollow, wherein the face member has a front face forming at least a part of a club face and a rear face facing the hollow, the face member is made of an unidirectionally rolled plate of a titanium alloy having alpha phase crystals, wherein in the front view of the head under the standard state of the head, the rolled direction of the unidirectionally rolled plate is inclined at an angle θ1 of not more than 30 degrees with respect to the horizontal direction, and the rear face is provided with a ribbed part to have a longitudinal direction inclined at an angle θ2 of not more than 30 degrees with respect to the vertical direction.

According to another aspect the present invention, a method for manufacturing the golf club head comprises:

a step of preparing the face member which comprises the steps of preparing the unidirectionally rolled plate by rolling the titanium alloy a plurality of times in one direction, cutting out a blank for the face member from the unidirectionally rolled plate, and forming the ribbed part on the cutout blank by machining, a step of preparing the main body member; and a step of assembling the face member and the main body member into the head.

DEFINITIONS

Here, the standard state of the club head is such that the club head is set on a horizontal plane HP so that the axis CL of the club shaft (not shown) is inclined at the lie angle β while keeping the axis CL on a vertical plane VP, and the club face 2 forms its loft angle α with respect to the vertical plane VP. Incidentally, in the case of the club head alone, the center line of the shaft inserting hole 7*a* can be used instead of the axis CL of the club shaft.

The sweet spot SS is the point of intersection between the club face 2 and a straight line N drawn normally to the club face 2 passing the center G of gravity of the head.

The front-back direction is a direction parallel with the straight line N projected on the horizontal plane HP.

The toe-heel direction TH is a direction parallel with the horizontal plane HP and perpendicular to the front-back direction.

The crown-sole direction CS is a direction perpendicular to the toe-heel direction TH, namely, a vertical direction.

The moment of inertia is the lateral moment of inertia around a vertical axis passing through the center G of gravity in the standard state.

If the edge (2*a*, 2*b*, 2*c* and 2*d*) of the club face 2 is unclear due to smooth change in the curvature, a virtual edge line (Pe) which is defined, based on the curvature change is used instead as follows. As shown in FIGS. 15-16, in each cutting plane E1, E2 - - - including the straight line extending between the sweet spot SS and the center G of gravity of the head, a point Pe at which the radius (r) of curvature of the profile line Lf of the face portion first becomes under 200 mm in the course from the center SS to the periphery of the club face is determined. Then, the virtual edge line is defined as a locus of the points Pe.

DESCRIPTION OF THE PREFERRED EMBODIMENTS

Figure 1:
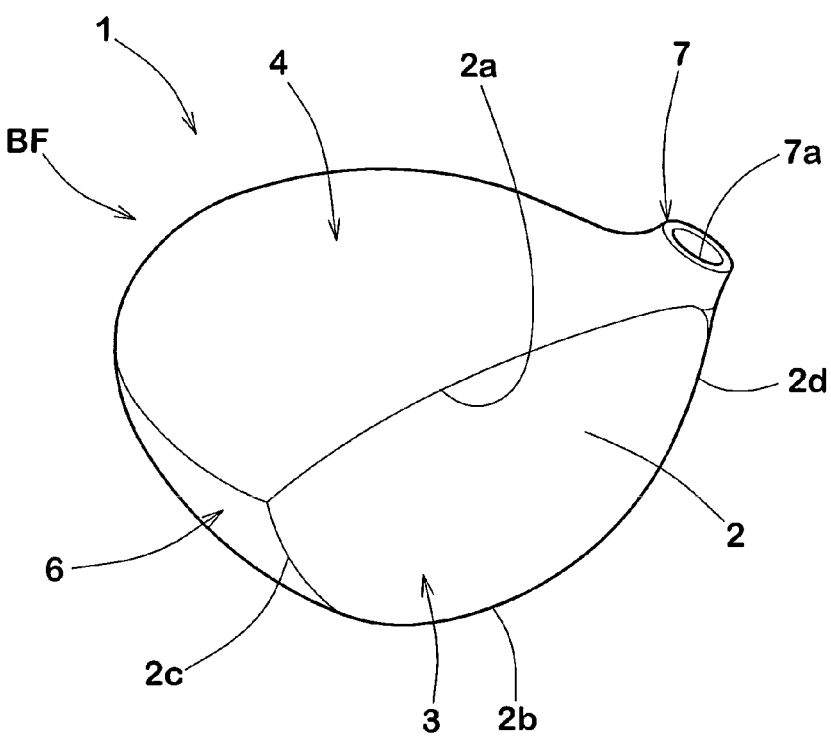
FIG. 1 is a perspective view of a golf club head according to the present invention.
Figure 2:
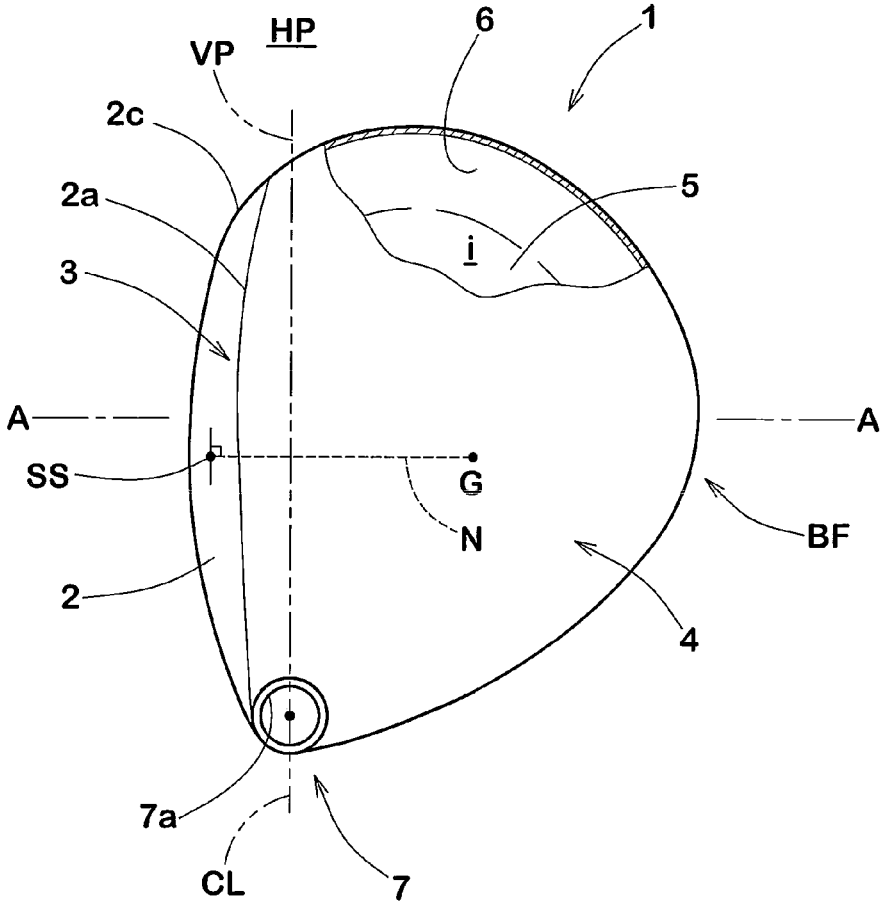
FIG. 2 is a top view thereof.
Figure 3:
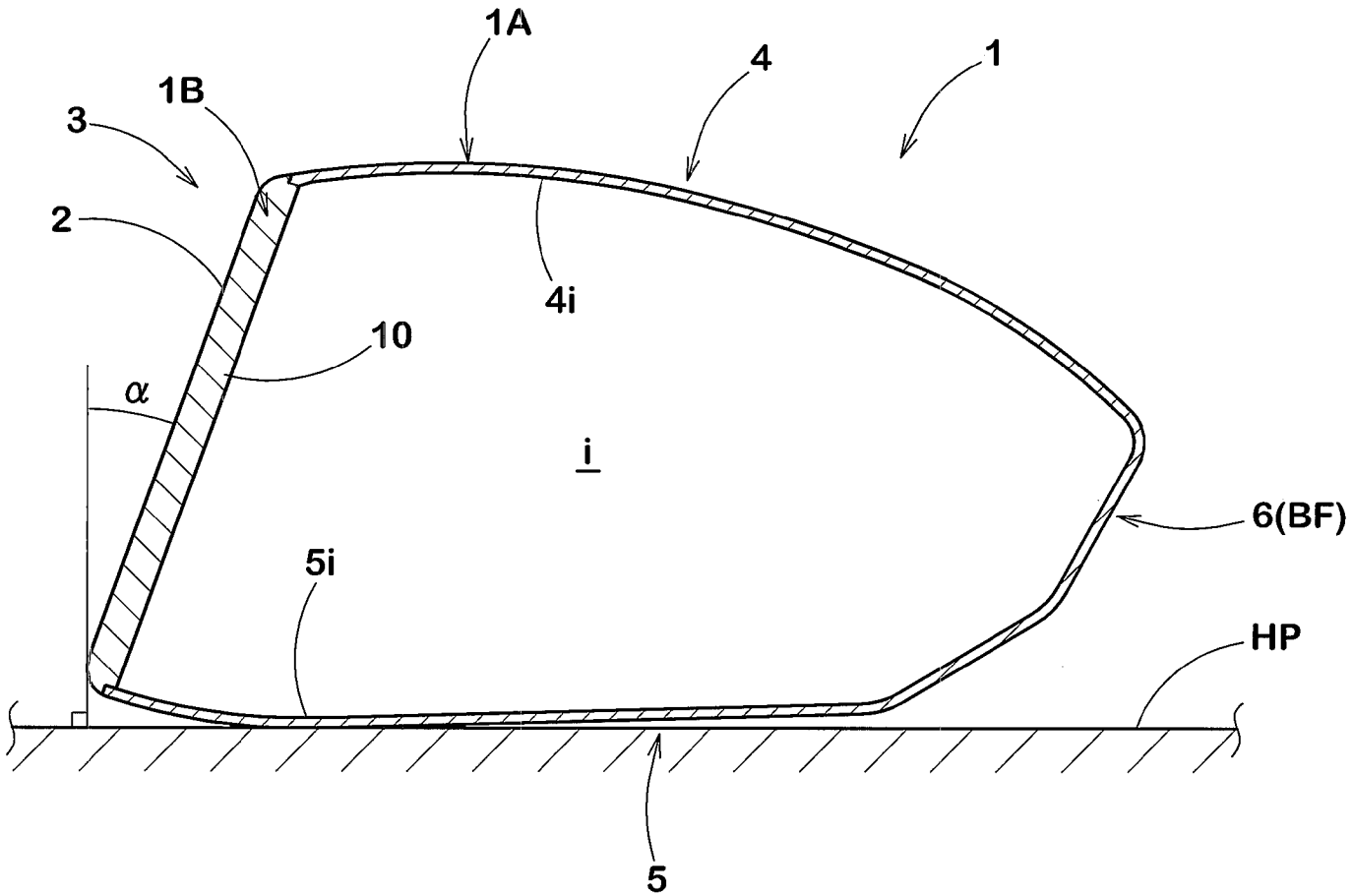
FIG. 3 is a cross sectional view taken along line A-A in FIG. 2.

Embodiments of the present invention will now be described in detail in conjunction with the accompanying drawings.

In the drawings, golf club head 1 according to the present invention is a hollow head for a wood-type golf club such as driver (#1) or fairway wood.

As shown in FIGS. 1-4, the head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hose 1 portion 7 at the heel side end of the crown to be attached to an end of a club shaft (not shown) inserted into the shaft inserting hole 7*a*. Thus, the club head 1 is provided with a hollow (i) and a shell structure with the thin wall.

In the case of a wood-type club head for a driver (#1), it is preferable that the head volume is set in a range of not less than 380 cc, more preferably not less than 400 cc, still more preferably not less than 420 cc, in order to increase the moment of inertia and the depth of the center of gravity G. However, to prevent an excessive increase in the club head weight and deteriorations of swing balance and durability and further in view of golf rules or regulations, the head volume is preferably set in a range of not more than 500 cc, more preferably not more than 470 cc, still more preferably not more than 460 cc.

The mass of the club head 1 is preferably set in a range of not less than 180 g, more preferably not less than 185 g, in view of the swing balance and rebound performance, but not more than 220 g, still more preferably not more than 215 g in view of the directionality and traveling distance of the ball.

The width FW of the club face 2, which is measured in the toe-heel direction along the club face 2 passing through the sweet spot SS, is preferably not less than 90.0 mm, more preferably not less than 92.0 mm, still more preferably not less than 95.0 mm, but not more than 110.0 mm, more preferably not more than 107.0 mm, still more preferably not more than 105.0 mm.

The height FH of the club face 2, which is measured in the crown-sole direction CS along the club face 2 passing through the sweet spot SS, is preferably not less than 48.0 mm, more preferably not less than 50.0 mm, still more preferably not less than 52.0 mm, but not more than 60.0 mm, more preferably not more than 58.0 mm, still more preferably not more than 56.0 mm.

The ratio (FW/FH) is more than 1.00, preferably not less than 1.65, more preferably not less than 1.70, still more preferably not less than 1.80 in order to lower the center G of gravity. However, if the ratio (FW/FH) is too large, the rebound performance greatly deteriorates. Therefore, the ratio (FW/FH) is preferably not more than 2.10, more preferably not more than 2.05, still more preferably not more than 2.00.

Figure 5:
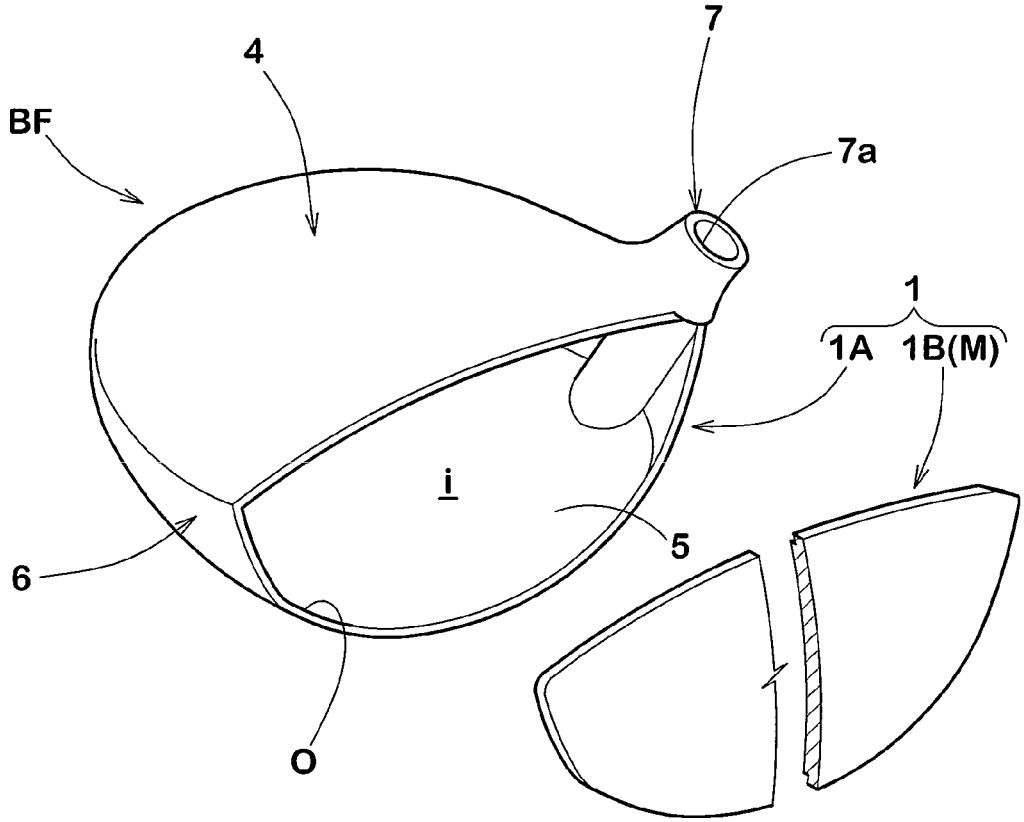
FIG. 5 is an exploded perspective view of the golf club head.

In this embodiment, the club head 1 is as shown in FIG. 5 compose of a hollow main body member 1A provided with an opening O in the front thereof, and a face member 1B attached to the main body member 1A so as to close the opening O.

The main body member 1A includes the crown portion 4, sole portion 5, side portion 6 and hose 1 portion 7. The main body member 1A is preferably formed in a one-piece structure by casting, but it is also possible to form it by assembling two or more parts which are prepared through suitable methods such as casting, forging, mold pressing and machining. As the material or materials of the main body member 1A, stainless steel, maraging steel, titanium, titanium alloy, aluminum alloy, magnesium alloy amorphous alloy and the like can be used alone or in combination.

Preferably, a metal material (for example, a titanium alloy such as Ti-6Al-4V, Ti-8Al-1V-1Mo and Ti-8Al-2V) weldable to the face member 1B is used in view of the production efficiency. It is however also possible to use a non-metal material such as fiber reinforced resin having a relatively small specific gravity in order to form a part of the main body member 1A. Furthermore, as a weight member to adjust the position of the center of gravity of the head, a metal material having a relatively large specific gravity such as tungsten can be used in combination with the above-mentioned light weight material(s).

The face member 1B is made from a unidirectionally rolled plate M of a titanium alloy having alpha phase crystals. The face member 1B in this embodiment is a slightly curved plate and forms the almost entirety of the face portion 3.

The titanium alloy having alpha phase crystals means an alpha alloy and alpha-beta alloy.

Since the alpha-beta alloys are higher in the strength than the alpha alloys, in the case that an alpha-beta alloy is used, the durability of the face portion 3 can be improved, and the face member 1B can be decreased in the thickness to reduce the weight and to increase the design freedman of the center of gravity, therefore, the use of the alpha-beta alloys is preferred. The alpha-beta alloys are for example, Ti-4.5Al-3V-2Fe-2Mo, Ti-4.5Al-2Mo-1.6V-0.5Fe-0.3Si-0.03C, Ti-8Al-1Mo, Ti-1Fe-0.35O-0.01N, Ti-5.5Al-1Fe, Ti-6Al-4V, Ti-6Al-6V-2Sn, Ti-6Al-2Sn-4Zr-6Mo, Ti-6Al-2Sn-4Zr-2Mo, Ti-8Al-1Mo-1V and the like. Especially, Ti-4.5Al-3V-2Fe-2Mo, Ti-4.5Al-2Mo-1.6V-0.5Fe-0.3Si-0.03C and Ti-1Fe-0.35O-0.01N are preferably used because of the high specific tensile strength and excellent workability. For example, Ti-5Al-2.5Sn is a typical alpha alloy.

Figure 11:
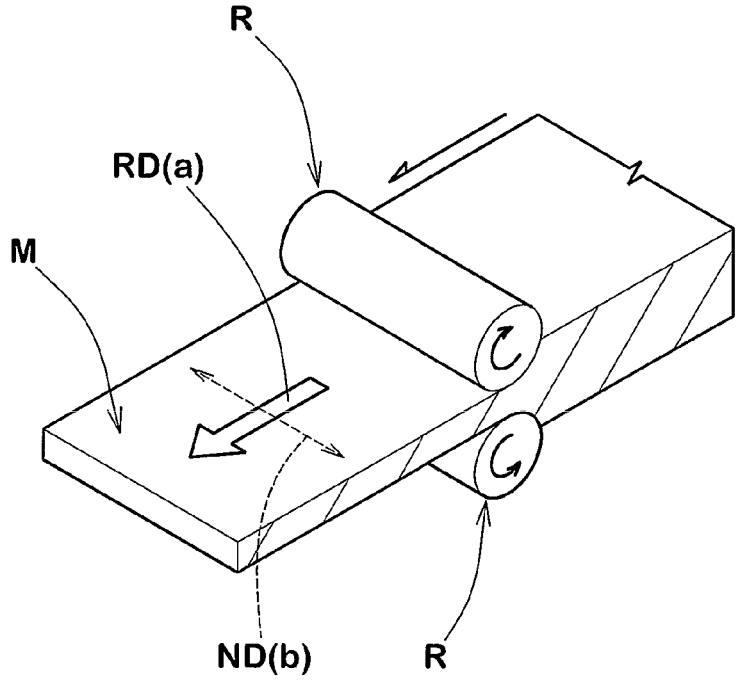
FIG. 11 is a schematic perspective view for explaining unidirectional rolling.

As shown in FIG. 11 the rolled metal plate M is formed by passing the titanium alloy material through between rotating rollers R. The unidirectionally rolled metal plate M is subject to such rolling operation a plurality of times without changing the rolled directions, namely, rolled in one rolled direction RD only.

Figure 12:
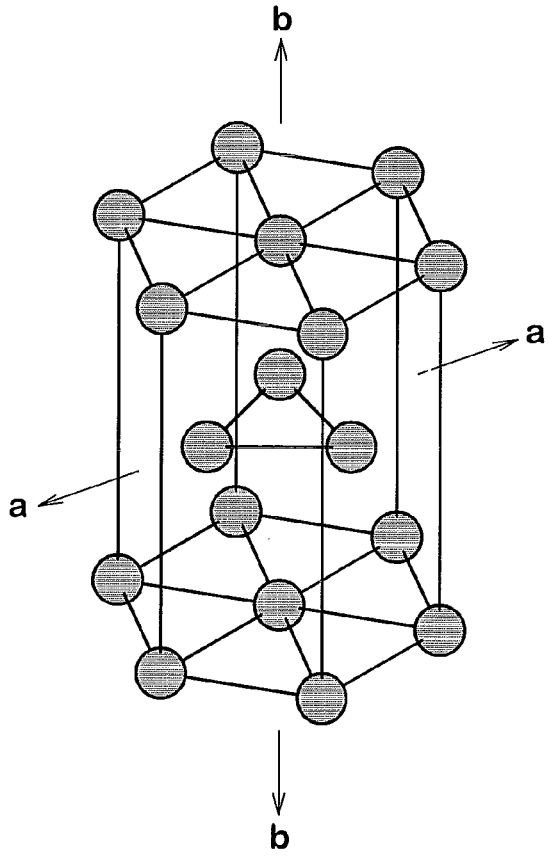
FIG. 12 is a diagram for explaining a hexagonal close-packed structure.

Alpha phase crystals of a titanium alloy have a hexagonal close-packed structure as shown in FIG. 12. This structure deforms easier in the axis (a) than the axis (b) substantially perpendicular thereto.

In the unidirectionally rolled plate M of the titanium alloy, the axes (a) of the hexagonal close packing crystals are orientated to extend along the rolled direction RD, and the axes (b) are orientated to extend along the direction ND perpendicular to the rolled direction RD.

Thus, the unidirectionally rolled metal plate M is provided with an orthotropic anisotropy such that the tensile elastic modulus Erd and tensile strength Srd in the rolled direction RD are less than the tensile elastic modulus Epd and tensile strength Spd in the perpendicular direction ND.

In the present invention, in order to increase the rigidity of the face portion 3 without increasing the mass of the face portion 3, such anisotropy is utilized.

In the front view of the head 1 under the above-mentioned standard state, the angle θ1 of the rolled direction RD of the unidirectionally rolled metal plate M is set to be not more than 30 degrees with respect to the horizontal direction K1. In other words, the direction ND perpendicular to the rolled direction RD in which direction ND the tensile elastic modulus becomes relatively large is set to be not more than 30 degrees with respect to the vertical direction. The reason therefor is as follows.

In the club face 2, the span between its upper edge 2*a* and lower edge 2*b* is shorter than the span between the toe-side edge 2*c* to heel-side edge 2*d*, therefore, by directing the perpendicular direction ND as above, the elasticity of the face portion 3 as a whole is effectively increased, and the spring-like effect can be lessened. If the angle θ1 is more than 30 degrees, the effect to lessen the spring-like effect decreases.

Figure 4:
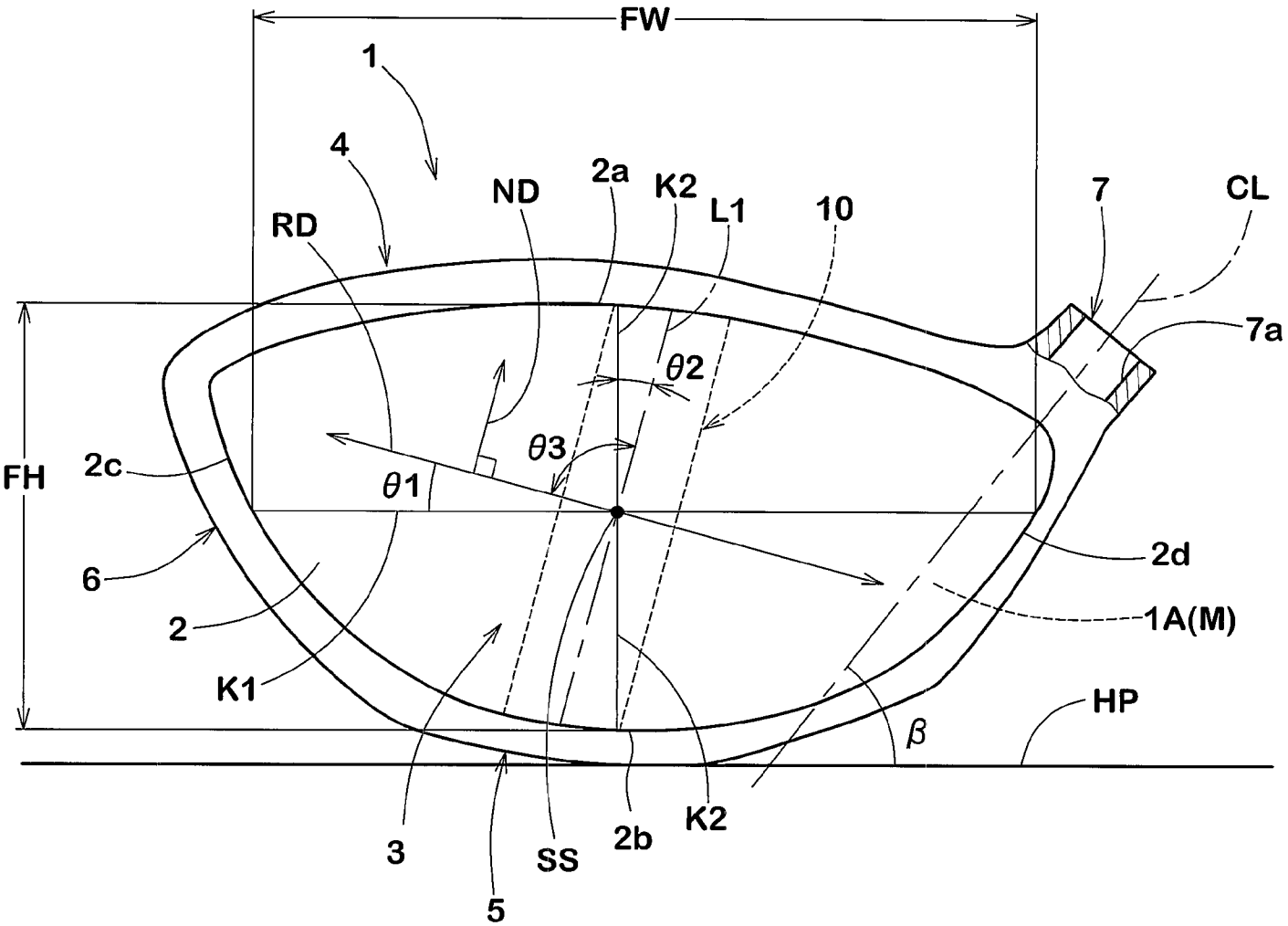
FIG. 4 is a front view thereof.

It is especially preferable that the rolled direction RD is inclined to the crown portion 4 from the heel towards the toe as shown in FIG. 4, and the angle θ1 is 5 to 30 degrees because of the following reason.

Figure 6:
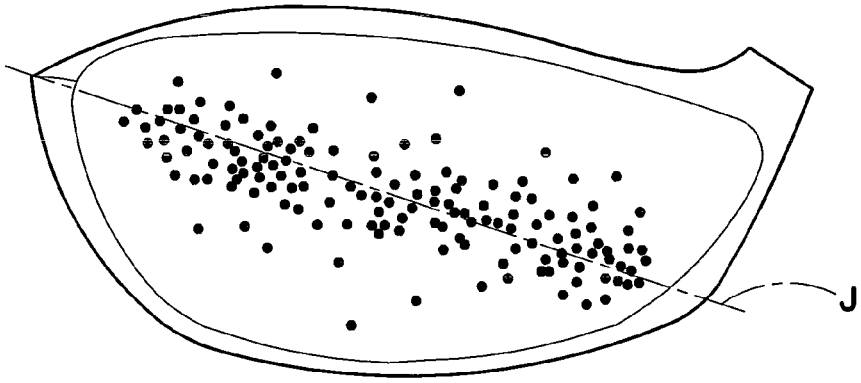
FIG. 6 is a distribution map of ball hitting positions of average golfers.

FIG. 6 is a distribution map of ball hitting positions of average golfers. As shown, the hitting positions concentrate along a straight line J inclined to the crown portion 4 from the heel towards the toe. Usually, this inclination angle is about 15 to 20 degrees with respect to the horizontal direction.

By orienting the rolled direction RD in the same direction as the longitudinal direction of the straight line J, since the elastic modulus in the rolled direction RD is smaller, even if the ball hits a position on the toe-side or heel-side of the sweet spot, the face portion 3 can deflect easier and the coefficient of restitution is increased. Thus, it becomes possible to increase the sweet spot area.

As the parameters showing the degree of the anisotropy of the unidirectionally rolled plate M, there are a ratio (Spd/Srd) of the tensile strength Srd in the rolled direction RD and the tensile strength Spd in the perpendicular direction ND, and a ratio (Epd/Erd) of the tensile elastic modulus Erd in the rolled direction RD and the tensile elastic modulus Epd in the perpendicular direction ND.

If the values of the ratios are too small, it becomes difficult to reinforce the face portion 3. If too large on the other hand, the strength in the toe-heel direction becomes insufficient and the durability is decreased.

Therefore, the tensile strength ratio (Spd/Srd) is preferably set in a range of not less than 1.20, more preferably not less than 1.25, still more preferably not less than 1.30, but not more than 1.60, more preferably not more than 1.50, still more preferably not more than 1.45.

The tensile elastic modulus ratio (Epd/Erd) is preferably set in a range of not less than 1.10, more preferably not less than 1.14, still more preferably not less than 1.18, but not more than 1.60, more preferably not more than 1.55, still more preferably not more than 1.50.

If the values of the tensile strength Srd and Spd are too small, it is difficult to provide an essential strength for the face portion 3, and the face portion 3 is fatigued and broken readily. In addition, there is a possibility that the reduced tensile elastic modulus increases the spring-like effect which will result in the golf club head which does not conform with the golf rules. If the values of the tensile strength Srd and Spd are too large, on the other hand, due to the increased tensile elastic modulus, the spring-like effect is greatly decreased, and the carry distance of the ball is decreased.

In view of the above, the tensile strength Spd is preferably not less than 1000 MPa, more preferably not less than 1100 MPa, still more preferably not less than 1150 MPa, but not more than 1500 MPa, more preferably not more than 1450 MPa, still more preferably not more than 1400 MPa.

The tensile strength Srd is preferably not less than 800 MPa, more preferably not less than 850 MPa, still more preferably not less than 900 MPa, but not more than 1200 MPa, more preferably not more than 1100 MPa, still more preferably not more than 1050 MPa.

The tensile elastic modulus Epd is preferably not less than 115 GPa, more preferably not less than 120 GPa, still more preferably not less than 125 GPa, but not more than 170 GPa, more preferably not more than 165 GPa, still more preferably not more than 160 GPa.

The tensile elastic modulus Erd is preferably not less than 90 GPa, more preferably not less than 95 GPa, still more preferably not less than 100 GPa, but not more than 125 GPa, more preferably not more than 120 GPa, still more preferably not more than 118 GPa.

Further, according to the invention, in addition to the provision of the anisotropy, the face portion 3 is provided on the rear face 3*b* with a ribbed part 10, namely, thicker part as shown in FIGS. 7-10.

Figure 7:
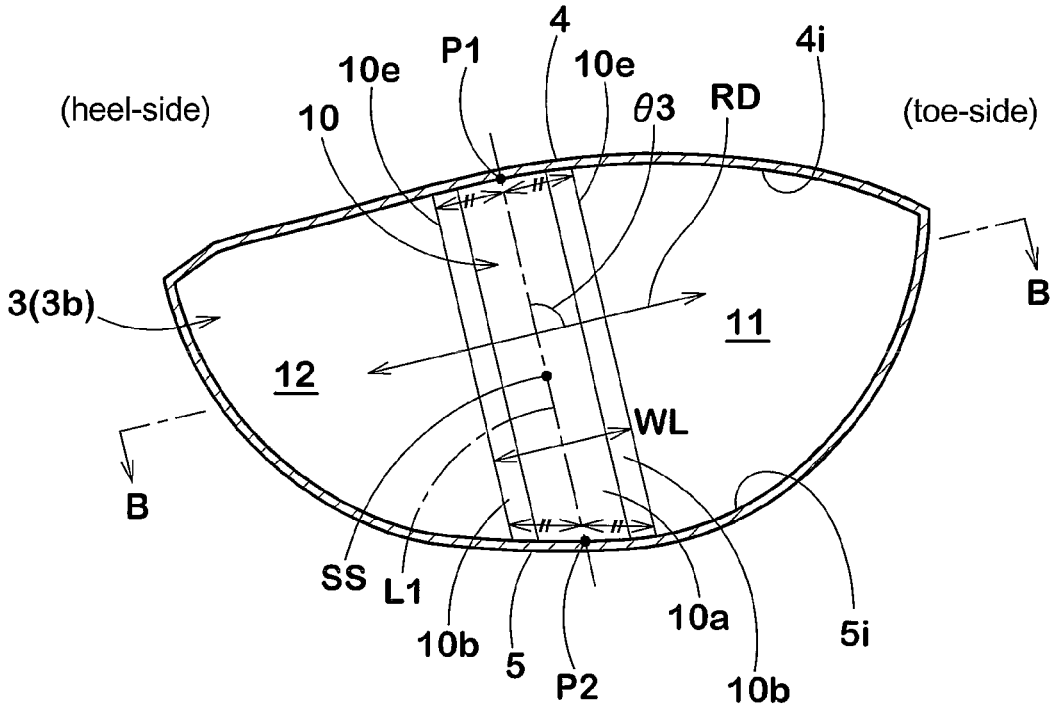
FIG. 7 is a rear view of an example of the face member.

The ribbed part 10 is arranged such that the longitudinal direction L1 thereof is inclined at an angle θ2 of not more than 30 degrees with respect to the vertical direction K2 in the front view of the head under the standard state as shown in FIG. 4. Here, the longitudinal direction of the ribbed part 10 is defined by that of a straight line (L1) drawn between the width center point P1 of the ribbed part 10 at the upper end and the width center point P2 of the ribbed part 10 at the lower end as shown in FIG. 7.

Figure 9:
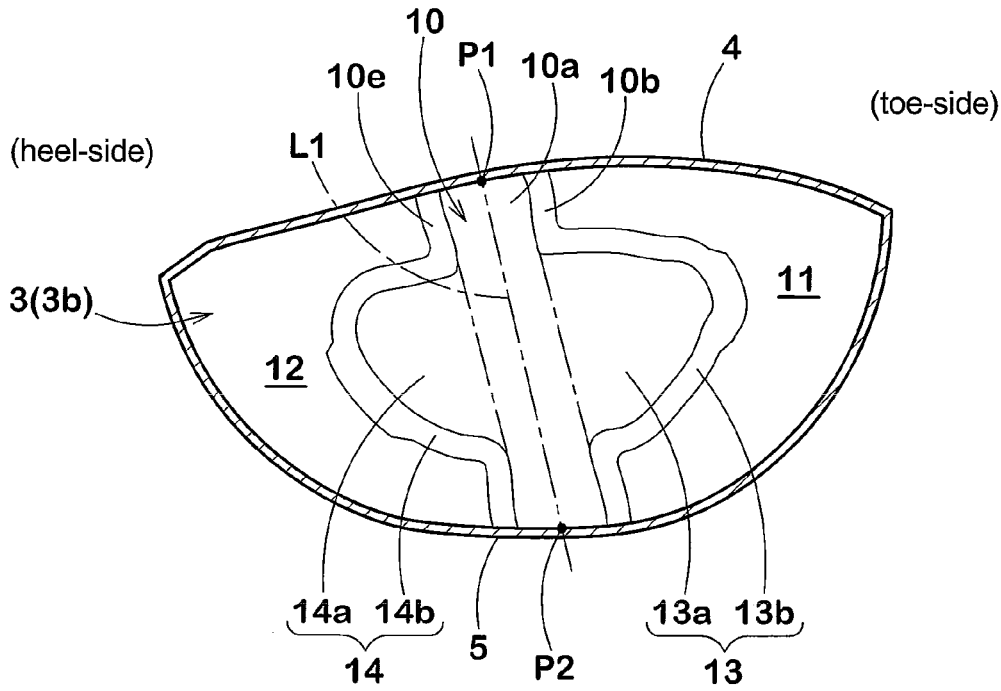
FIGS. 9 and 10 are rear views similar to FIG. 7 each showing another example of the face member.

It is especially preferable that the ribbed part 10 is inclined along the direction perpendicular to the straight line J of the distribution of the hitting positions of the average golfers, namely, inclined to the heel from the sole portion towards the crown portion as shown in FIG. 9, and the angle θ2 is in a range of from 5 to 30 degrees. If the angle θ2 of the ribbed part 10 is more than 30 degrees, there is possibility that the spring-like effect increases.

Since the ribbed part 10 extends between the crown and sole portions while having a certain width and a relatively larger thickness, in cooperation with the anisotropy of the unidirectionally rolled metal plate M, the ribbed part 10 is effectively increased in the strength and rigidity in the crown-sole direction. Therefore, even if the width and thickness of the ribbed part 10 are relatively small, the spring-like effect can be effectively decreased. Namely, the spring-like effect can be decreased while minimizing the weight increase of the face portion.

The angle θ3 between the longitudinal direction L1 of the ribbed part 10 and the rolled direction RD is preferably set in a range of from 75 to 105 degrees, more preferably 85 to 95 degrees, most preferably 90 degrees.

It is desirable that the ribbed part 10 extends continuously from the inner surface 4*i* of the crown portion 4 to the inner surface 5*i* of the sole portion 5.

In this embodiment, the number of the ribbed part 10 is one, but a plurality of ribbed parts 10 can be provided. In such case, the number of the ribbed parts 10 is preferably not more than 5, more preferably not more than 4, still more preferably not more than 3 in order to avoid an undesirable increase of the weight of the face portion 3.

In the case of a single ribbed part 10 as in this embodiment, the ribbed part 10 is positioned on the center of the club face so as to include the sweet spot SS. In the case of a plurality of ribbed parts 10, it is preferable that one of the ribbed parts is positioned to include the sweet spot SS.

If the width WL of each ribbed part 10 is less than 2 mm, it becomes difficult to control the spring-like effect. If the total width WL of the ribbed part or parts 10 is more than 25 mm, the spring-like effect is decreased greatly beyond the limit and the carry distance of the ball is decreased. Further, the weight of the face portion 3 is unfavorably increased. Therefore, the width WL of the ribbed part 10 measured perpendicularly to the above-mentioned longitudinal direction L1 is preferably set in a range of not less than 2 mm, more preferably not less than 3 mm, still more preferably not less than 5 mm, but in total not more than 25 mm, more preferably not more than 20 mm, still more preferably not more than 15 mm. The ribbed part 10 in this embodiment has a substantially constant width WL from the upper end to the lower end, but it is also possible to provide a variable width WL preferably within the above-mentioned range.

Figure 8:
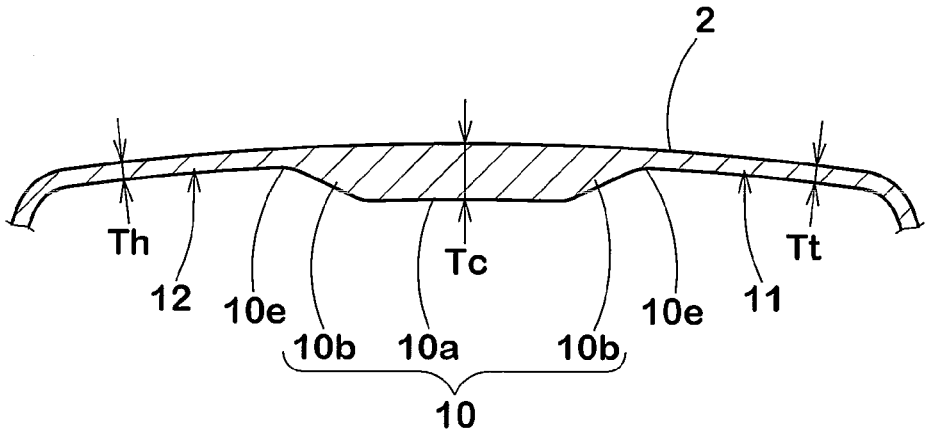
FIG. 8 is a cross sectional view taken along line B-B in FIG. 7.

If the maximum thickness TC of the ribbed part 10 is less than 2.8 mm, the face reinforcing effect in the crown-sole direction is decreased and it becomes difficult to control the spring-like effect. If the maximum thickness of the ribbed part 10 exceeds 5.0 mm, the spring-like effect is made almost void. Further, the mass of the face portion 3 is unfavorably increased. Therefore, as shown in FIG. 8, the maximum thickness TC of the ribbed part 10 is preferably not less than 2.8 mm, more preferably not less than 3.0 mm, still more preferably not less than 3.1 mm, but not more than 5.0 mm, more preferably not more than 4.0 mm, still more preferably not more than 3.8 mm.

In order to prevent stress concentration, the ribbed part 10 in this embodiment comprises a central part 10*a* having a substantially constant thickness, and a pair of lateral parts 10*b* disposed on the heel-side and toe-side of the central part 10*a* and having a variable thickness gradually decreasing from the central part 10*a* towards the side edge 10*e* of the ribbed part 10.

In this embodiment, on the toe-side and heel-side of the single ribbed part 10, a toe-side thinner part 11 and a heel-side thinner part 12 are formed as a consequence. The thinner parts 11 and 12 each have a thickness Tt, Th less than the ribbed part 10. Each of the thicknesses Tt and Th is substantially constant and smallest in the face portion 3. Therefore, the mass of the face portion 3 is decreased. Further, even if the ball hitting position is off centered towards the heel or toe, the ball hitting part of the face portion 3 is effectively deflected, and the loss of the carry distance can be lessened. Namely, the sweet spot area can be extended towards the toe and heel.

The thicknesses Tt and Th are preferably in a range of not more than 3.0 mm, more preferably not more than 2.8 mm, still more preferably not more than 2.5 mm, but not less than 1.5 mm, more preferably not less than 1.8 mm, still more preferably not less than 1.9 mm in view of the durability of the face portion 3.

The difference (Tc−Tt) between the thickness Tt and the maximum thickness Tc of the ribbed part 10 and the difference (Tc−Th) between the thickness Th and the maximum thickness Tc are preferably not less than 0.5 mm, more preferably not less than 0.7 mm, still more preferably not less than 0.9 mm, but not more than 2.0 mm, more preferably not more than 1.8 mm, still more preferably not more than 1.6 mm.

If the thickness difference is less than 0.5 mm, it is difficult to increase the rigidity of the face portion 3. If the thickness difference is more than 2.0 mm, there is a possibility that the durability deteriorates.

FIG. 9 shows a modification of the embodiment shown in FIG. 7. In this example, the face member 1B is further provided with a toe-side thick part 13 and a heel-side thick part 14 on both sides of the ribbed part 10 respectively.

The toe-side thick part 13 is formed continuously from the middle part of the ribbed part 10 and protrudes towards the toe to have a contour shape similar to that of the club face.

The heel-side thick part 14 is formed continuously from the middle part of the ribbed part 10 and protrudes towards the heel to have a contour shape similar to that of the club face.

The thick parts 13 and 14 can increase the rigidity of the center zone of the face portion 3 and the durability thereof can be improved.

In this example, each of the thick parts 13 and 14 comprises a thick main portion 13*a*, 14*a* having the same thickness as the thickness Tc of the above-mentioned central part 10*a* of the ribbed part 10, and a tapered portion 13*b*, 14*b* formed along the edge of the thick main portion 13*a*, 14*a* and having a gradually decreasing thickness.

If the area of the thick parts 13 and 14 is too large, the spring-like effect is greatly decreased and the carry distance decreases, and the mass of the face portion 3 unfavorably increases. Therefore, the total area of the thick parts 13 and 14 is preferably in a range of not more than 30%, more preferably not more than 25%, still more preferably not more than 23% of the overall area of the rear face of the face portion 3.

Figure 10:
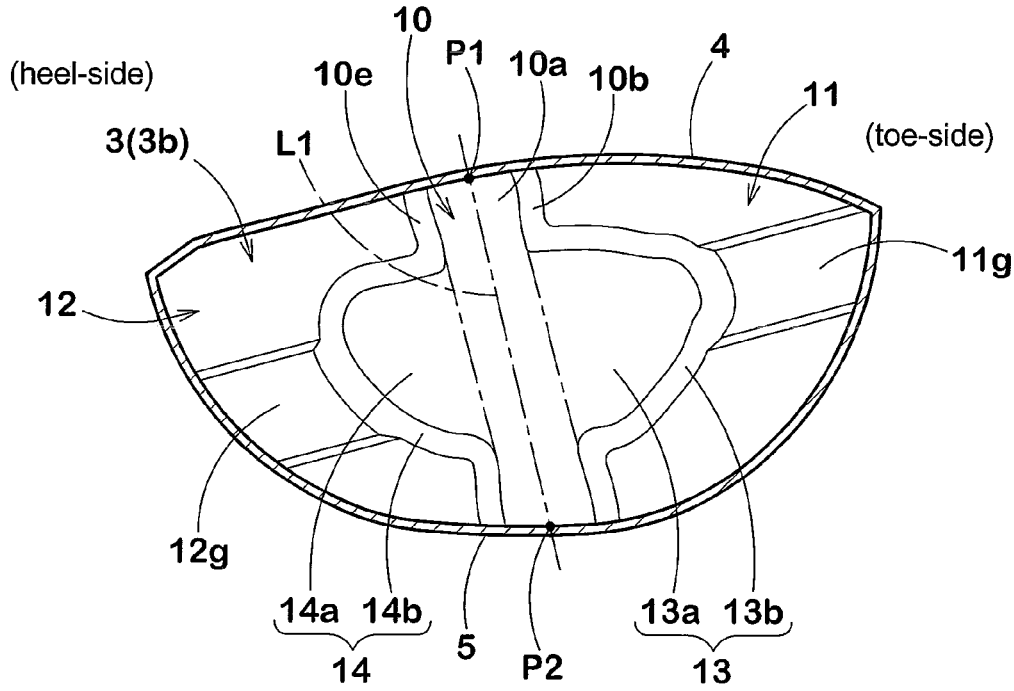

FIG. 10 shows a further modification of the embodiment shown in FIG. 9. In this example, the face member 1B is provided with a toe-side groove 11*g* and a heel-side groove 12*g* in the above-mentioned toe-side thinner part 11 and heel-side thinner part 12, respectively. Accordingly, the thickness is reduced in the grooves 11*g* and 12*g* in comparison with the thinner parts 11 and 12, respectively. The toe-side groove 11*g* and heel-side groove 12*g* extend in the toe-heel direction or the rolled direction RD along the line J. Therefore, the rebound performance at the time of off-center shots towards the toe or heel is improved, and the sweet spot area can be increased in the toe-heel direction. In order to secure the durability, the thickness of the face portion 3 measured at the bottom of the groove 11*g*, 12*g* is preferably set to be not less than 1.5 mm.

The above-mentioned face member 1B is made from the unidirectionally rolled plate M having a substantially constant thickness.

As shown in FIG. 11, the unidirectionally rolled plate M is formed by passing the titanium alloy material through between rotating rollers R, wherein the titanium alloy material drawn by the friction is decreased in its thickness or cross sectional area. The unidirectionally rolled plate M is subject to such rolling operation a plurality of times without changing the rolled directions, namely, in one rolled direction RD as explained above.

As to the rolling operation, either hot rolling or cold rolling can be employed in this invention.

Here, the hot rolling means that carried out at a material temperature of higher than 200 degrees C.

The cold rolling means that carried out at a material temperature of lower than 200 degrees C.

In order to increase the elastic modulus anisotropy while achieving a high strength, it is desirable that the material is subjected to hot rolling as rough rolling and then cold rolling as finish rolling.

In the rough rolling, the material is rolled 2 to 10 times, preferably 3 to 8 times by heating the material at a temperature in a range of from 700 to 1100 degrees C., more preferably 800 to 1000 degrees C.

In the subsequent finish rolling, the material is rolled 2 to 10 times, preferably 3 to 7 times by keeping the temperature of the material within a range between ambient temperatures and 200 degrees C., preferably between ambient temperatures and 150 degrees C.

As a result, precipitates generated in the material during casting and rough crystal grains are fractured, and the crystal is close-packed, therefore, the strength and toughness of the material can be increased.

The total number of times to apply rolling (in the above case, rough rolling and finish rolling) is preferably not less than 7, more preferably not less than 9, but not more than 15, more preferably not more than 12. If more than 15 times, due to very high activity of a titanium alloy, there is a high possibility that the surface of the material is covered by a thick oxide film. If less than 7 times, it is difficult to obtain a sufficient anisotropy. Further, since the rolling ratio per rolling increases, there is a possibility that the homogeneity of the material deteriorates.

The rolling ratio (gross) of the unidirectionally rolled plate M is preferably not less than 70%, more preferably not less than 75%, but not more than 95%, more preferably not more than 90%. If the gross rolling ratio is less than 60%, there is a possibility that the precipitates and rough crystal grains can not be fully fractured, and the orientation of the hexagonal close packing crystals becomes insufficient, therefore, it is difficult to obtain the undermentioned desirable anisotropy values. If the rolling ratio is more than 95%, there is a high possibility that the rolled material is cracked. Further, in view of the production cost, it is not preferable.

Here, the rolling ratio (or reduction of rolling) is $$\{(h1-h2)/h1\}\times 100(\%)$$

wherein h1 is the thickness before rolling, and h2 is thickness after rolling.

In the above-mentioned case, during the rough rolling, the rolling ratio in each time is preferably set in a range of not less than 60%, more preferably not less than 70%, but not more than 94%, more preferably not more than 90%.

During the finish rolling, the rolling ratio is preferably set in a range of not less than 2%, more preferably not less than 3%, but not more than 20%, more preferably not more than 15%.

Figure 13:
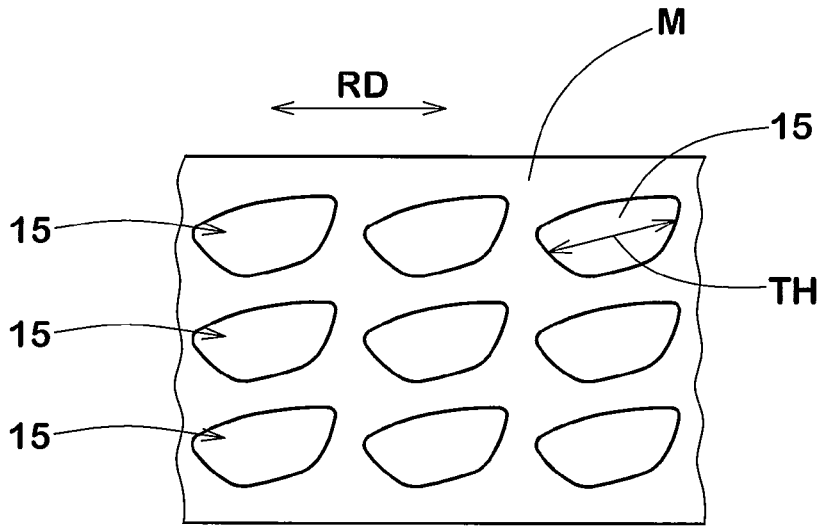
FIG. 13 shows an arrangement of cutout blanks for the face members on the unidirectionally rolled metal plate.

As shown in FIG. 13, from the unidirectionally rolled plate M having a constant thickness, blanks 15 for the face members are cut out by the use of for example cutting dies, laser beam or the like so that the rolled direction RD becomes not more than 30 degrees with respect to the toe-heel direction TH as explained above.

Figure 14:
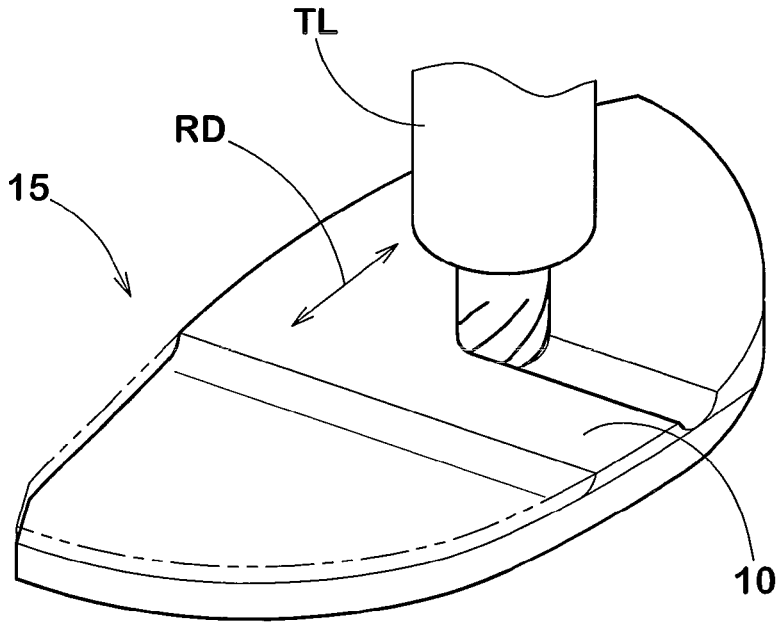
FIG. 14 is a schematic perspective view for explaining a machine work to the face member.
Figure 15:
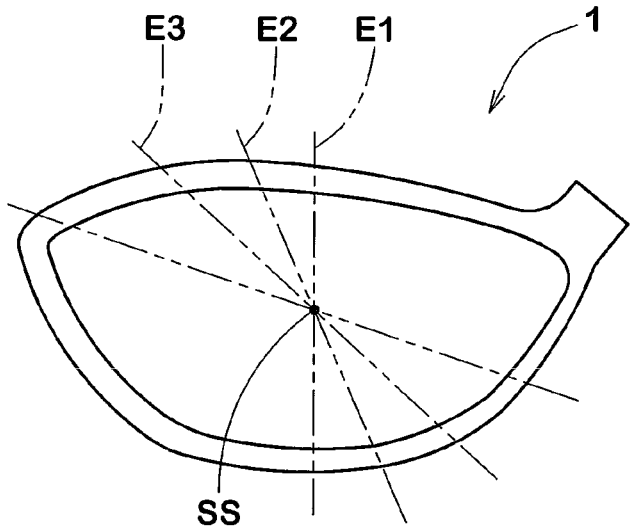
FIGS. 15 and 16 are a front view and a cross sectional view of a face portion of a head for explaining the edge of the club face.
Figure 16:
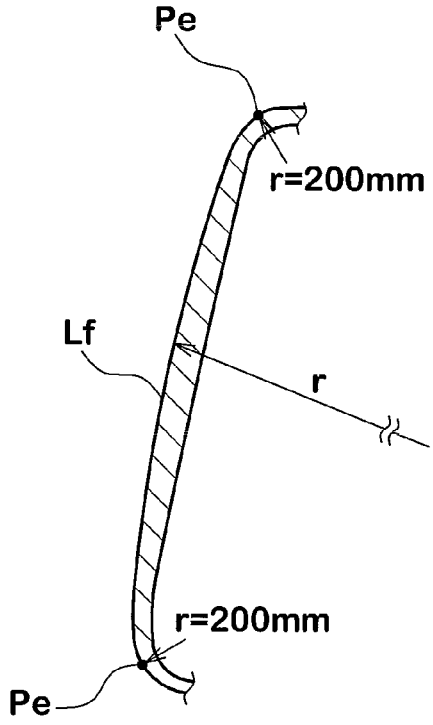

Then, as schematically shown in FIG. 14, in order to form the ribbed part 10 and the optional thick parts 13 and 14 grooves 11g and 12g, the cutout blank 15 is machined by the use of a cutting tool TL of a numerically-controlled milling machine for example. By using the machining rather than mold press and forging, it is possible to maintain the anisotropy of the unidirectionally rolled metal plate M after the ribbed part 10 and the like are formed.

As to the bulge and roll (curvature) of the club face 2, such curvature can be provided before or after the above-mentioned machining.

The main body member 1A can be formed by assembling two or more parts which are prepared through suitable methods such as casting, forging, mold pressing and machining.

In this embodiment, however, the main body member 1A is formed by lost-wax precision casting.

The face member 1B and the main body member 1A are fixed to each other to form the club head 1 by means of, for example, welding (Tig welding, plasma welding, laser welding etc.), soldering, press fitting or the like. Among them, laser welding is preferred because the heat affected zone is small and the joint strength is high.

Comparison Tests

Wood club heads (head volume 460 cc, loft 10 degrees, lie 57.5 degrees) were prepared and tested for the spring-like effect and durability and the weight of the face member was measured.

Figure 17:
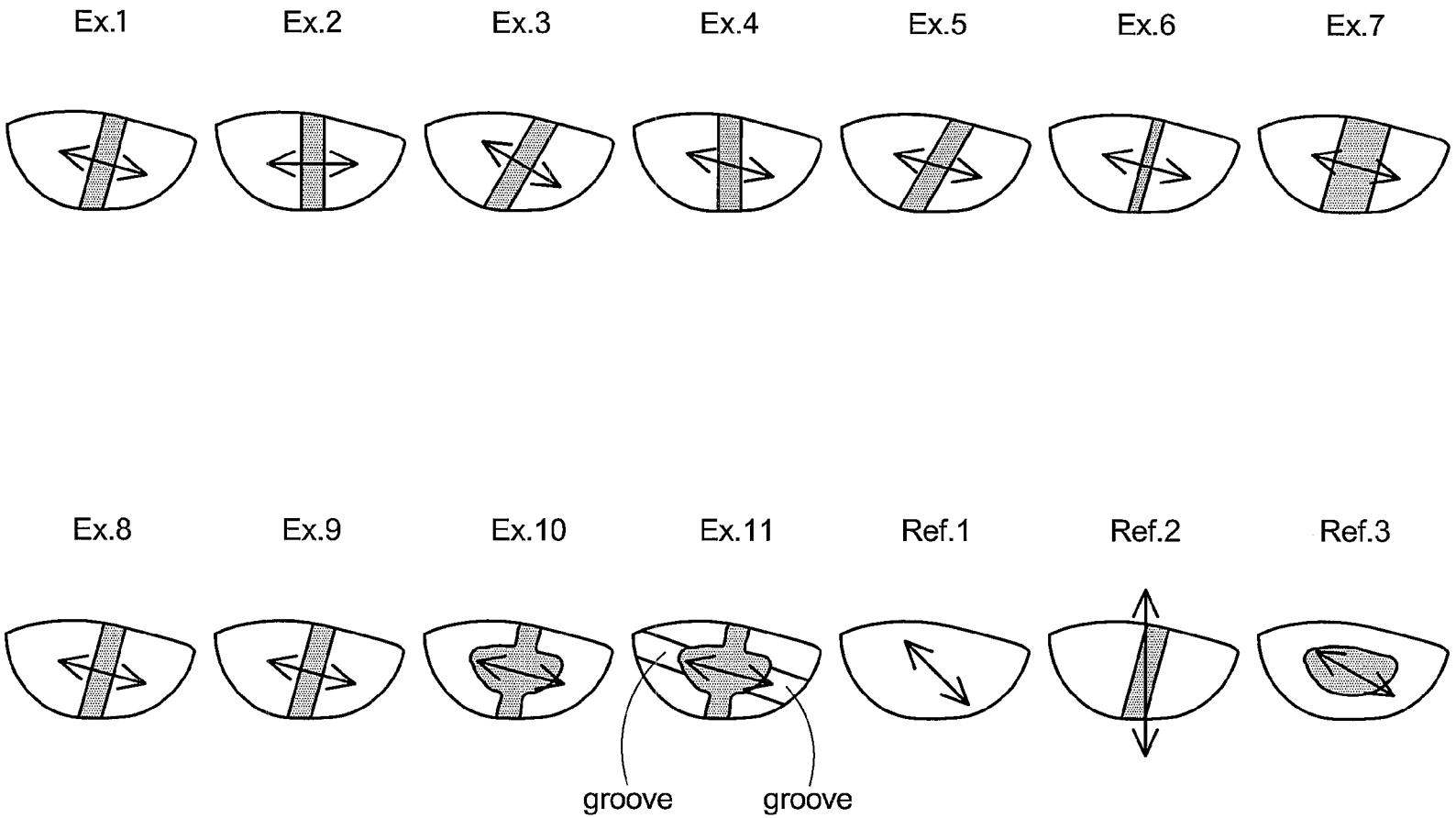
FIG. 17 is a diagram of the face members used in the undermentioned comparison Tests showing arrangements of the ribbed part and rolled direction.

The heads were prepared by combining identical main body members and face members having specifications shown in FIG. 17 and Table 1.

In FIG. 17 showing the face members used in the tests, the dark parts indicate thicker parts such as ribbed parts, and the lines with two arrowheads indicate rolled directions RD.

The rolling was carried out as follows.

Rough rolling material temperature: 940 degrees C.

number of times to roll: 7 rolling ratio: 82%

Finish rolling material temperature: ambient temperature number of times to roll: 5 rolling ratio: 9%

Finished thickness: 5.0 mm

Gross rolling ratio: 83%

All of the face members were made of an alpha-beta titanium alloy Ti-4.5Al-2Mo-1.6V-0.5Fe-0.3Si-0.03C, and formed by cutting out their blanks from the same unidirectionally rolled metal plate using cutting dies. Then, using a NC milling machine, the ribbed parts and grooves (Ex. 11) were formed.

The main body member was a casting of a titanium alloy Ti-6Al-4V formed by a lost-wax precision casting method.

In order to fix the face member to the main body member, plasma welding was utilized.

The details of the test are as follows.

Pendulum Test

According to the R&A and the United states Golf Association's "Pendulum Test", each of the head was measured for the "Characteristic Time (CT)". The larger the CT value, the larger the spring-like effect. The upper limit for the CT value is 239 microseconds with a test tolerance of 18 microseconds. Therefore, considering the tolerance, the CT value must be not more than 257 microseconds. The values under 250 microseconds are desirable. The results are shown in Table 1.

Durability Test

Each head was attached to a FRP shaft (SRI sports Ltd. SV-3003J, Flex X) to make a 45-inch wood club, and the club was mounted on a swing robot. Then, the head hit golf balls 10000 times (maximum) at the head speed of 54 meter/second, while checking the face portion every 100 times.

The number of hitting times at which any damage was observed, is indicated by an index based on Ref. 3 being 100, wherein the larger the value, the better the durability.

TABLE 1

| Head | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ref. 1 | Ref. 2 | Ref. 3 |
|---|---|---|---|---|---|---|---|---|---|---|---|---|---|---|
| angle θ1 (deg.) | 15 | 0 | 30 | 15 | 15 | 15 | 15 | 15 | 15 | 15 | 15 | 45 | 90 | 30 |
| angle θ2 (deg.) | 15 | 0 | 30 | 0 | 30 | 15 | 15 | 15 | 15 | 15 | 0 | 15 | 15 | — |
| angle θ3 (deg.) | 90 | 90 | 90 | 75 | 105 | 90 | 90 | 90 | 90 | 90 | 90 | 60 | 15 | — |

TABLE 1-continued

| Head | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ref. 1 | Ref. 2 | Ref. 3 |
|---|---|---|---|---|---|---|---|---|---|---|---|---|---|---|
| width WL (mm) | 10 | 10 | 10 | 10 | 10 | 2 | 30 | 10 | 10 | 10 | 10 | 10 | 10 | — |
| thickness Tc (mm) | 3.8 | 3.8 | 3.8 | 3.8 | 3.8 | 3.8 | 3.8 | 2.9 | 4.7 | 3.8 | 3.8 | 3.8 | 3.8 | 3.8 |
| thickness Tt, Th (mm) | 2.5 | 2.5 | 2.5 | 2.5 | 2.5 | 2.5 | 2.5 | 2.5 | 2.5 | 2.5 | 2.5 | 2.5 | 2.5 | 2.5 |
| (Tc − Tt), (Tc − Th) (mm) | 1.3 | 1.3 | 1.3 | 1.3 | 1.3 | 1.3 | 1.3 | 0.4 | 2.2 | 1.3 | 1.3 | 1.3 | 1.3 | 1.3 |
| thickness at groove bottom (mm) | — | — | — | — | — | — | — | — | — | — | 2.0 | — | — | — |
| Mass of Face member (g) | 45.0 | 44.9 | 45.1 | 44.9 | 45.1 | 42.7 | 50.8 | 43.0 | 47.0 | 47.3 | 45.6 | 45.0 | 45.0 | 45.6 |
| Pendulum test CT value (microseconds) | 240 | 239 | 242 | 242 | 245 | 255 | 222 | 254 | 234 | 240 | 241 | 259 | 263 | 260 |
| Durability (index) | 140 | 145 | 130 | 135 | 120 | 105 | 230 | 105 | 145 | 150 | 145 | 105 | 95 | 100 |

It was confirmed from the test results that, according to the present invention, the CT values can be restricted to under the regulation limit, while improving the durability, without a substantial increase in the mass of the face member.

The present invention is suitably applied to wood-type hollow golf club heads as explained above, but it is also possible to apply iron-type golf club heads.

The invention claimed is:

1. A golf club head having a hollow structure comprising a main body member provided with an opening in the front thereof, and a face member closing the opening so as to form a hollow, the face member having a front face forming at least a part of a club face and a rear face facing the hollow, and the face member made of an unidirectionally rolled plate of a titanium alloy having alpha phase crystals and having an aeolotrophy satisfying at least one of (i) the ratio (Spd/Srd) of the tensile strength Spd of the unidirectionally rolled plate in the direction ND, perpendicular to the rolled direction RD to the tensile strength Srd of the unidirectionally rolled plate in the rolled direction RD, is not less than 1.20 and not more an 1.60, and (ii) the ratio (Epd/Erd) of the tensile elastic modulus Epd of the unidirectionally rolled plate in the direction ND, perpendicular to the rolled direction RD to the tensile elastic modulus Erd, of the unidirectionally rolled plate in the rolled direction RD, is not less than 1.10 and not more than 1.60, wherein said rear face is provided with a single ribbed part, extending continuously from a front edge of a crown portion of the head to a front edge of a sole portion of the head through a sweet spot, while defining a part having a substantially constant thickness between the upper end and lower end of the ribbed part, the longitudinal direction of the ribbed part, which is defined as the direction of a straight line drawn between the widthwise center point of the ribbed part at its upper end and the widthwise center point of the ribbed part at its lower end, is inclined at an angle θ2 of not less than 5 degrees and not more than 30 degrees with respect to the vertical direction such that said widthwise center point at the upper end is positioned on a heel side of said widthwise center point at the lower end, the rolled direction of the unidirectionally rolled plate is inclined at an angle of from 5 to 30 degrees with respect to the horizontal direction, and said longitudinal direction of the ribbed part is substantially perpendicular to the rolled direction of the face member, and said rear face is further provided with a toe-side groove (11*g*) and a heel-side groove (12*g*) extending from a middle part of the ribbed part toward the toe side and the heel side thereof, respectively, along the rolled direction.

2. The golf club head according to claim 1, wherein the width of the ribbed part measured perpendicularly to its longitudinal direction is in a range of from 2 to 25 mm, and the maximum thickness of the ribbed part is in a range of from 2.8 to 5.0 mm.

3. The golf club head according to claim 1, which has a club face having a width FW in a range of not less than 90.0 mm and not more than 110.0 mm when measured in the toe-heel direction along the club face passing through the sweet spot, and a height FH in a range of not less than 48.0 mm and not more than 60.0 mm when measured in the crown-sole direction along the club face passing through the sweet spot.

4. The golf club head according to claim 3, wherein the ratio (FW/FH) of the width FW to the height FH is not less than 1.65 and not more than 2.10.

5. The golf club head according to claim 1, wherein on the toe-side of the ribbed part, a toe-side thinner part is formed by the toe-side groove and the difference (Tc−Tt) of the thickness Tc of the ribbed part from the thickness Tt of the toe-side thinner part is not less than 0.5 mm and not more than 2.0 mm, and on the heel-side of the ribbed part, a heel-side thinner part is formed by the heel-side groove and the difference (Tc−Th) of the thickness Tc of the ribbed part from the thickness Th of the heel-side thinner part is not less than 0.5 mm and not more than 2.0 mm.

6. The golf club head according to claim 5, wherein the thickness measured at the bottom of each of the toe-side and heel-side grooves is not less than 1.5 mm.

7. The golf club head according to claim 1, wherein the ribbed part (10) comprises:

a central part (10*a*) having a substantially constant thickness and extending along the longitudinal direction (L1); and a pair of lateral parts (10*b*) disposed on the heel-side and toe-side of the central part (10*a*) respectively and having a variable thickness gradually decreasing from said central part (10*a*) towards the side edge of the ribbed part (10).

8. The golf club head according to claim 1, wherein said straight line of the ribbed part extends on the sweet spot.

9. The golf club head according to claim 1, wherein the face member (1B) is further provided with a toe-side thick part (13) and a heel-side thick part (14), the toe-side thick part (13) is formed in a toe-side of the ribbed part (10) and protrudes towards the toe to have a contour shape similar to that of the club face, defining said middle part, and the heel-side thick part (14) is formed in a heel-side of the ribbed part (10) and protrudes towards the heel to have a contour shape similar to that of the club face, defining said middle part.

10. The golf club head according to claim 1, wherein the tensile strength Spd is not less than 1000 MPa and not more than 1500 MPa, and the tensile strength Srd is not less than 800 MPa and not more than 1200 MPa.

11. The golf club head according to claim 1, wherein the tensile elastic modulus Epd is not less than 115 GPa and not more than 170 GPa, and the tensile elastic modulus Erd is not less than 90 GPa and not more than 125 GPa.

12. The golf club head according to claim 1, wherein the thickness of the ribbed part is 2.8 to 5.0 mm.

* * * * *